US005262753A

United States Patent [19]

Duplaix

[11] Patent Number: 5,262,753

[45] Date of Patent: Nov. 16, 1993

[54] PYROTECHNIC CONTROLLED ELECTRICAL SWITCH WITH CONDUCTIVE FOIL BRIDGING CONTACT DISK

[75] Inventor: Bernard R. Duplaix, Mehun sur Yevre, France

[73] Assignee: Giat Industries, Versailles, France

[21] Appl. No.: 917,947

[22] Filed: Jul. 24, 1992

[30] Foreign Application Priority Data

Jul. 25, 1991 [FR] France ..... 91 09456

[51] Int. Cl.[5] ..... H01H 37/64; H01H 39/00

[52] U.S. Cl. ..... 337/413; 200/52 R; 200/83 N

[58] Field of Search ..... 200/52 R, 61.08, 82 R, 200/83 R, 83 N; 337/401, 407–409, 413; 102/202.5, 202.9, 202.14

[56] References Cited

U.S. PATENT DOCUMENTS

| | | | |
|---|---|---|---|
| 3,248,504 | 4/1966 | McGirr et al. | 337/409 |
| 3,795,195 | 3/1974 | Irish, Jr. et al. | 102/38 |
| 3,803,374 | 4/1974 | Delgendre et al. | 200/61.08 |
| 3,932,717 | 1/1976 | Dike et al. | 200/61.08 |
| 4,150,266 | 4/1979 | Patrichi | 200/61.08 |
| 4,339,638 | 7/1982 | Lascelles et al. | 200/52 R |

FOREIGN PATENT DOCUMENTS

| | | |
|---|---|---|
| 7802836 | 6/1978 | Fed. Rep. of Germany . |
| 7802837 | 6/1978 | Fed. Rep. of Germany . |
| 2755322 | 6/1979 | Fed. Rep. of Germany . |

*Primary Examiner*—J. R. Scott
*Attorney, Agent, or Firm*—Oliff & Berridge

[57] ABSTRACT

An electrical switch with pyrotechnic control includes a housing containing a pyrotechnic composition and at least two contacts applicable, for example, to fire an explosive charge in a military application such as a warhead. The switch includes a thin foil having at least one conductive part spaced in the vicinity of the pyrotechnic composition by a spacing washer directly opposite the contacts. Triggering of the composition throws the thin foil in contact with the contacts to complete an electrical connection. The switch is operable with a small amount of the pyrotechnic composition and has a reduced controllable response time.

9 Claims, 3 Drawing Sheets

PYROTECHNIC CONTROLLED ELECTRICAL SWITCH WITH CONDUCTIVE FOIL BRIDGING CONTACT DISK

BACKGROUND OF THE INVENTION

The field of the present invention is that of pyrotechnically controlled electrical switches.

Switches of this type are used for example to fire an explosive charge in a warhead or in systems for emergency opening of aircraft doors.

U.S. Pat. No. 4,339,638 describes a switch in which a piston is displaced by the action of gas pressure supplied by a pyrotechnic composition. This piston pushes a switch assembly that makes a number of electrical connections between the pins. The switch assembly is held in the disconnected position by a small collar sheared by the advance of the piston.

A switch of this kind suffers from several disadvantages. The shearing of the collar, the displacement of the two movable parts, and the establishment of contacts by deformation of conducting elements require considerable force and a non-negligible mass of pyrotechnic composition.

Displacement of several parts likewise involves relatively long response times, and the reproducibility of performance will be poor owing to the difficulty involved in reducing the coefficient of friction of one switch on another over the entire range of operating temperatures.

A switch of this kind is therefore absolutely unsuitable for weapons use, for example to fire a warhead with a response time on the order of a microsecond and a reliability on the order of 99%, and in a temperature range from −50° C. to +60° C.

German patent DE 2,755,322 describes an electrical switch in which the gases generated by burning a pyrotechnic composition cause displacement of a piston to bring it into contact with a stop.

The stop is connected electrically with a first electrical conductor and the body of the first piston is itself connected to a second conductor through the sheath of the switch.

The piston is held in its resting position by a pin that is sheared when the pressure rises, and is then held in its contact position with the stop by deformation, under the influence of the gas pressure, of a pan that surrounds the pyrotechnic composition and is displaced to push the piston.

A switch of this kind also requires a large amount of pyrotechnic composition to shear the pin and to move the piston and the pan.

In addition, the friction, which is difficult to reduce, increases the response time and reduces the reliability of the switch.

Further, the quality of the contact obtained can be random since it depends both on the quality of the contact between the pan and piston and the quality of the contact between the piston and the stop.

It is therefore possible for play to remain between the piston and stop when the pan is deformed and jammed against the wall of the switch body.

German utility models DE-U-7802837 and DE-U-7802836 describe pyrotechnically controlled switches in which the pressure generated by a gas-generating composition pushes a conducting plate through a ring having a conical shape.

The pressure of the gases deforms the plate, which then assumes a concave shape that allows it to make electrical contact between two conductors supported by the housing.

The friction of the periphery of the plate against the conical shape of the ring ensures an elastic grip between the plate and the conductors.

This type of switch also requires a large amount of pyrotechnic composition to move and deform the plate.

In addition, the quality of the electrical contact obtained depends on the rigidity of the fit of the plate against the conical surface of the ring and on the mechanical characteristics of the material of which the plate is made.

A switch of this kind therefore does not possess a sufficient degree of reliability.

SUMMARY OF THE INVENTION

A goal of the invention is to propose a pyrotechnically controlled electrical switch that requires only a reduced amount of pyrotechnic composition.

Another goal of the invention is to propose a switch with pyrotechnic control of sturdy design but also offering extremely reduced response time, significant reliability, and excellent quality of the electrical contact obtained.

The invention has an electrical switch with pyrotechnic control and comprising a housing inside which is located a pyrotechnic composition as well as at least two contacts. The pyrotechnic composition is of the primary type and the switch further includes a relatively thin foil and at least one conducting part, the foil being located in the vicinity of the pyrotechnic composition and held in place by a spacing washer directly opposite the contacts in such manner that it can be thrown against the contacts when the pyrotechnic composition is triggered.

BRIEF DESCRIPTION OF THE DRAWINGS

The invention will be better understood after reading the description of the specific embodiments, with reference to the attached figures wherein.

DETAILED DESCRIPTION OF PREFERRED EMBODIMENTS

The contacts are preferably mounted on a single flat surface located opposite the conducting foil and parallel thereto.

Advantageously, the contacts are mounted in a base comprising at least one peripheral electrode and one central electrode, separated by an insulator, the latter possibly being of glass.

According to one embodiment, the pyrotechnic composition is located in a cavity whose bottom is closed by a spring in contact with the conducting foil.

Advantageously, the switch comprises a conducting housing containing the base, the housing having an opening permitting passage of the central base electrode and with a peripheral base electrode being in electrical contact with an internal surface of the housing.

The conducting foil can be kept at a distance from the base by a washer.

According to one embodiment, the cavity is held in contact with the conducting foil by a tubular support made integral with the housing by a connecting means.

The pyrotechnic composition can comprise lead azide and the conducting foil can be a copper foil between 0.2 and 0.5 mm thick.

Figure 1:
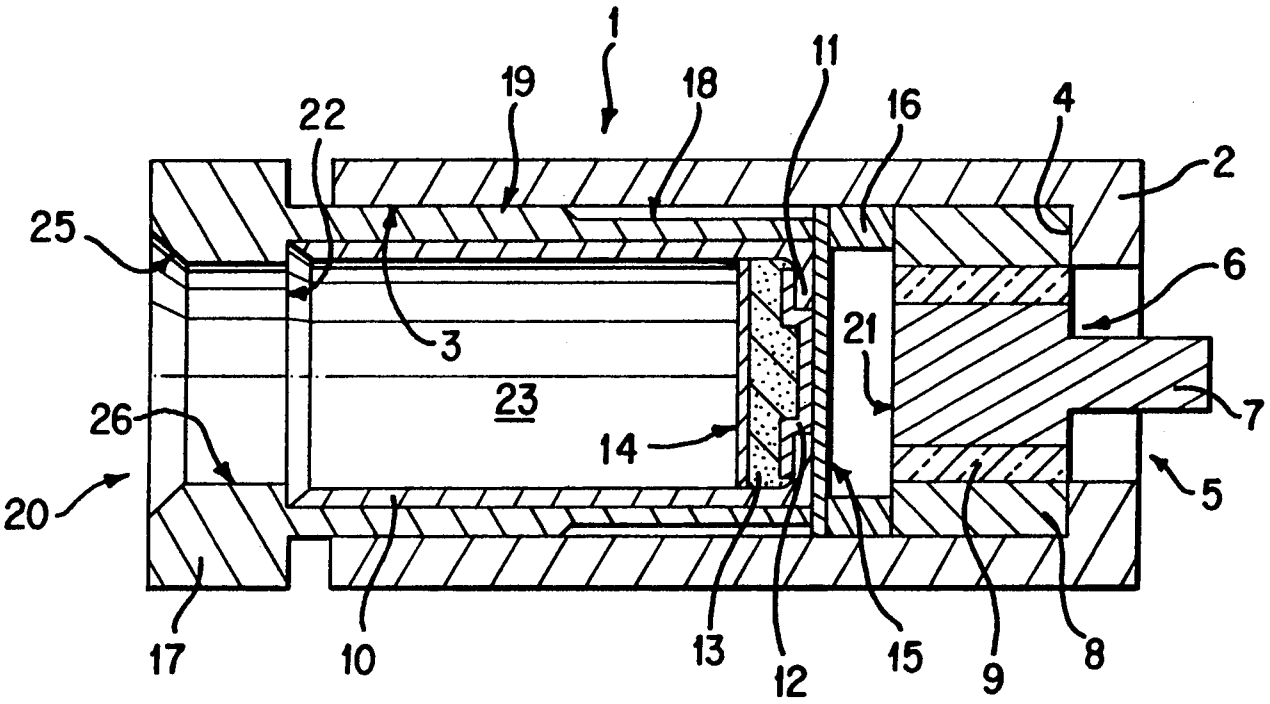
FIG. 1 is an axial section through a switch according to a first embodiment of the invention.

With reference to FIG. 1, an electrical switch 1 with pyrotechnic control according to the invention comprises a housing 2, essentially cylindrical and made of a conducting material, for example steel. This housing has an internal cylindrical recess 3 terminated by a wall 4 in which an opening 5 is provided.

A base 6 is located inside recess 3 and is in contact with both wall 4 and the internal surface of recess 3.

The base comprises a central electrode 7 and a peripheral electrode 8 which in this case is in the shape of a cylindrical crown. These two elements are made of conducting materials and are separated by a crown made of an insulating material 9.

For example, a base 8 can be used, including central electrode 7 and peripheral electrode 8 made of stainless steel and separated by glass.

Such glass/metal bases are in current use in making pyrotechnic components such as primers.

Nevertheless, it would be possible to make the base by mechanical assembly of conducting elements (7, 8) and insulating element 9, for example by gluing or molding.

The base has a flat surface 21 oriented toward the interior of housing 2, at which surface the electrodes are visible and present contact surfaces. Central electrode 7 emerges from the housing 2 through opening 5 and peripheral electrode 8 is in electrical contact with the material of housing 2.

A washer 16 whose outside diameter is essentially equal to that of recess 3 of housing 2 and whose inside diameter is greater than the outside diameter of insulating crown 9 is in contact with flat surface 21. The washer may or may not be a conductor.

A conducting foil 15, for example a copper foil 0.2 to 0.5 mm thick, is located directly opposite the contact surfaces visible on flat surface 21 and is held away from the latter by washer 16.

This foil is in contact with a cavity 10 made for example of stainless steel and containing a small quantity, on the order of several milligrams, of a primary pyrotechnic composition 13 comprising for example lead azide.

Cavity 10 has an opening 11 closed by a spring 12, made of tin for example, several tenths of a millimeter thick.

Pyrotechnic composition 13 is gently compressed (at 100 MPa, for example) inside cavity 10 and tin spring 12 thus essentially assumes the shape of opening 11 and is in contact with conducting foil 15 after cavity 10 is mounted in housing 2.

A paper foil 14 is located and glued to the primary composition, thus ensuring that the composition is held in place.

A tubular support 17 has a shoulder 22 on which the open end of cavity 10 rests, so that support 17 holds cavity 10 in contact with conducting foil 15.

Support 17 likewise holds conducting foil 15 in contact with washer 16.

Support 17 has a forward part 18 with a diameter smaller than that of recess 3 of housing 2 and a rear part 19 whose diameter is slightly greater than that of recess 3. Thus, when support 17 is force-fitted into the recess in housing 2, this difference in diameter constitutes a means of relative connection between these two elements.

Other connecting means may be used, for example crimping, gluing, or screwing.

Once assembly has been completed, electrical switch 1 has at one end two electrical contacts, namely the outer surface of housing 2 and central electrode 7, and at the other end, a mouthpiece 20 communicating with a chamber 23.

The outer surface of the housing 2 and the central electrode 7 are designed to be connected to an electrical circuit (not shown) for example to trigger a primer in a warhead. The means for connection to the circuit are of known type, soldering for example. To form these connections, it is also possible to provide threads on central electrode 7 and/or on the outer surface of housing 2.

Chamber 23 is designed to receive a triggering means for pyrotechnic composition 13.

Figure 2:
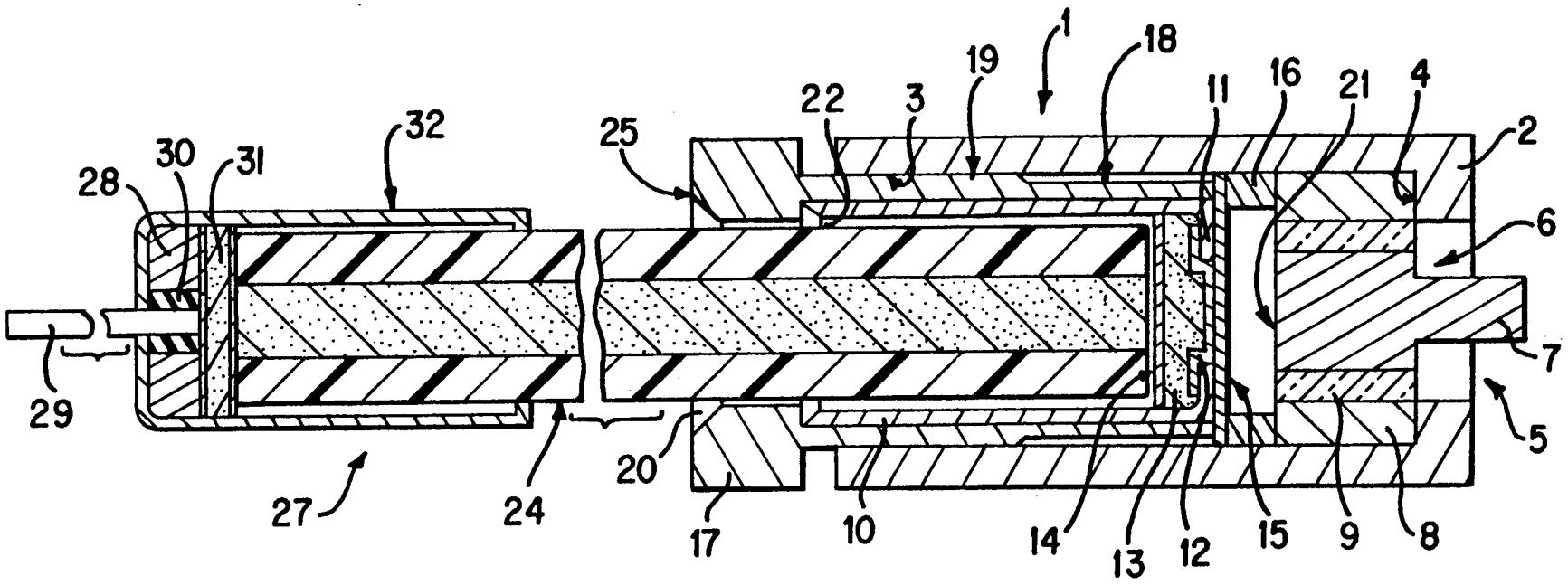
FIG. 2 shows the same switch, containing a fuse.

With reference to FIG. 2, one possible triggering means includes a fuse 24 of the NONEL (registered trademark) type for transmitting a detonation wave, the fuse comprising a plastic tube having a small amount of the primary pyrotechnic composition on its cylindrical internal surface.

Tubes of this kind permit transmission of the detonation wave from one end to the other without creating destructive effects in radial directions.

Installation of the fuse 24 is facilitated by a chamfer 25 on mouthpiece 20. The fuse 24 is driven into chamber 23 until it comes into contact with insulating paper foil 14. Wall 26 of tubular support 17 is slightly conical, producing a slight deformation of the wall of the fuse 24 and making it possible to ensure relative retention of the fuse 24 and switch 1.

At its other end, the fuse 24 has a known triggering device comprising, for example, an electrically triggered detonator primer 27.

This primer 27 comprises in known fashion a cavity 32 in the conducting material (steel, for example) containing a primary composition 31 (such as lead azide). Composition 31 is in contact with a filament (not shown here) and forms a resistance bridge between two conductors 28 and 29 separated by an insulator 30.

The device operates as follows: Fuse 24 is triggered by primer 27. When the detonation wave arrives at pyrotechnic composition 13, the latter is triggered in turn and throws conducting foil 15 onto flat surface 21 of base 6. Foil 15 thus covers the contact surfaces of electrodes 7 and 8 and forms an electrical connection between central electrode 7 and peripheral electrode 8.

Foil 15 is sheared after being thrown against the contact surface by washer 16.

Since foil 15 is of reduced thickness (0.2 to 0.5 mm), the energy required to shear it and throw it onto the contacts is reduced, and it is not necessary to provide a significant amount of pyrotechnic composition.

Nevertheless, the reliability of the switch is excellent and its response time is extremely short.

Thus, response times on the order of several microseconds are obtained, with excellent reliability.

This is due mainly to the fact that there is only one moving part of small mass, namely the conducting foil. Its displacement involves violent throwing under the influence of the detonation, and it is therefore not disturbed by friction.

When the switch 1 is located in a projectile, its resistance to firing forces is also excellent, with the conducting foil 15 being wedged between washer 16 and cavity 10 and possessing negligible inertia.

Surprisingly, it has been found that the switch according to the invention permits making contact between the electrodes in a permanent fashion, since the violence of the throwing causes partial melting of the conducting foil, which thus becomes totally integral with base 6 and the contact surfaces of the electrodes which emerge at flat surface 21 of the base. Flat surface 21 is thus practically metallized.

It is possible to adjust the response time of the switch accurately by varying the distance between the conducting foil and the base, the thickness of the conducting foil, or the weight of the pyrotechnic composition used.

In practice, a copper foil 0.2 mm thick located 1 mm from the base and thrown by a composition of 20 mg lead azide produces excellent results.

It is possible to design a switch according to the invention in which the base carries electrodes of any shape.

Thus, the electrodes can have rectangular or even cylindrical cross sections. In all cases, the electrodes will have contact surfaces located on flat surface 21 of the base, the surfaces being designed to receive metal foil 15.

It is likewise possible to make switches that allow several separate contacts to be closed or to connect a plurality of contacts together.

Figure 3:
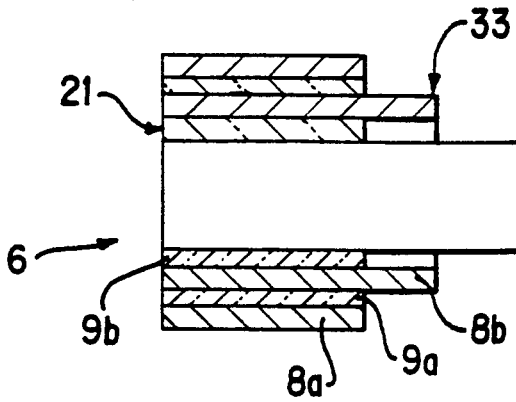
FIG. 3 is an axial section through an electrode-carrying base used in a switch according to a second embodiment of the invention.

FIG. 3 is an axial section of a base 6 comprising a central electrode 7 and two peripheral electrodes 8*a* and 8*b*, both of which have the shape of cylindrical crowns. The various electrodes are separated by crowns made of insulating material 9*a* and 9*b*.

Base 6 has a flat surface 21. Peripheral electrode 8*a* is designed, as in the previous example, to come in contact with a conducting housing, while peripheral electrode 8*b* has a cylindrical projection 33 coaxial with central electrode 7 and extending toward the rear of base 6.

This extension is designed to facilitate the electrical connection of peripheral electrode 8*b* with the electrical circuits in which the switch according to the invention is included.

As a result of the triggering of the pyrotechnic composition, the conducting foil comes in contact with flat surface 21 and forms an electrical connection among the three electrodes.

Figure 4A:
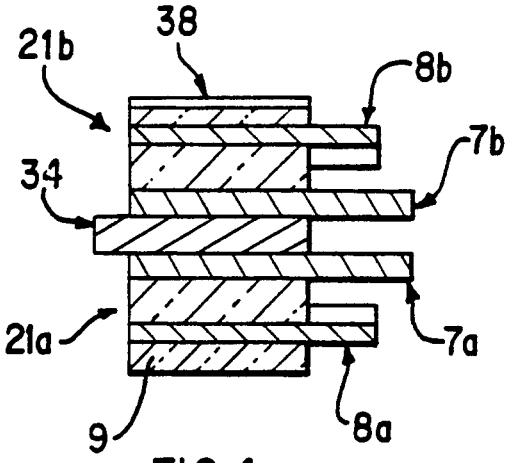
FIGS. 4*a* and 4*b* are views, in axial section and front elevation respectively, of an electrode-holding base used in a switch according to a third embodiment of the invention.
Figure 4B:
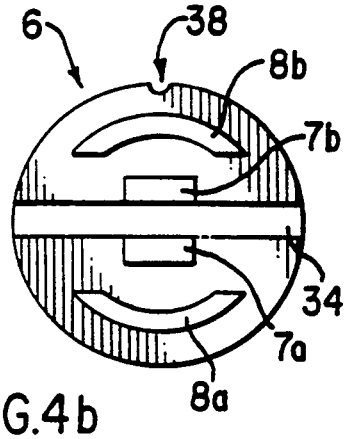

FIGS. 4*a* and 4*b* show another version of base 6 in which two central electrodes 7*a* and 7*b* which are essentially parallelepipedic and two peripheral electrodes 8*a* and 8*b* in the shape of portions of cylindrical crowns and coaxial with the base are embedded in a block of insulating material 9.

Insulating block 9 has at its forward part, an essentially rectangular small bar 34 oriented axially with respect to the base. Bar 34 delimits, at the front part of the base, two flat surfaces 21*a* and 21*b*, in which are located the ends of electrodes 7*a*, 8*a* and 7*b*, 8*b*.

Figure 4C:
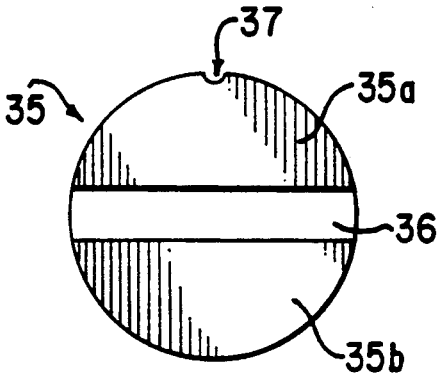
FIGS. 4*c* and 4*d* are views, in front elevation and axial section respectively, showing the conducting foil used in the base in FIGS. 4*a* and 4*b*.
Figure 4D:
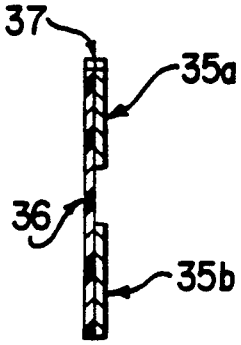

A conducting foil 35 used with the base 6 just described is shown in FIG. 4*c* in a front elevation and in FIG. 4*d* in axial section. Foil 35 has two conducting areas 35*a* and 35*b*, made of copper for example, several tenths of a millimeter thick and integral with an insulating support 36, made of Mylar for example, several hundredths of a millimeter thick.

This copper is deposited on the Mylar by vapor deposition or by gluing, for example.

Foil 35 is installed in the switch with an angular position such that conducting area 35*a* is opposite flat surface 21*b*.

It is convenient to provide means for ensuring, during assembly, that the base and foil are installed with the correct relative orientation.

For example, one could make a cut 37 in foil 35 and a cut 38 in base 6, the cuts being designed to receive a projection (not shown here) integral with the internal surface of the housing and extending in an axial direction of the latter.

As a result of the triggering of the pyrotechnic composition, conducting foil 35 comes in contact with flat surfaces 21*a* and 21*b*. The dimensions of conducting areas 35*a* and 35*b* are chosen such that contact is made between electrodes 7*a* and 8*a* on the one hand and between 7*b* and 8*b* on the other, without any relative connection between contacts 7*a* and 7*b*. Such a variation thus allows a single pyrotechnic command to form two separate electrical connections.

I claim:

1. An electrical switch with pyrotechnic control comprising a housing containing a pyrotechnic composition of the primary type, at least two contacts, and a thin foil having at least one conducting part, said foil being located in the vicinity of the pyrotechnic composition between the pyrotechnic composition and the contacts and being initially held spaced from the contacts by a spacing washer located directly opposite the contacts such that the at least one conducting part of the foil is projectable directly onto the contacts when the pyrotechnic composition is triggered, due to the force of the triggered pyrotechnic composition, to complete an electrical connection.

2. The switch according to claim 1, wherein the contacts are on a same flat surface parallel to said conducting foil.

3. The switch according to claim 2, wherein the contacts are mounted on a base affixed to the housing, the base comprising at least one peripheral electrode and a central electrode, separated by an insulating material, said peripheral electrode and said central electrode forming at least a part of said contacts.

4. The switch according to claim 3, wherein said insulating material is glass.

5. The switch according to claim 1, wherein said pyrotechnic composition is located in a cavity having a bottom formed by a spring in contact with said conducting foil.

6. The switch according to claim 5, wherein said housing is conductive and contains an internal surface and a base fixedly mounted to the housing including at least one peripheral electrode and a central electrode separated by an insulating material, said conductive housing having an opening permitting passage of said central electrode of said base, said peripheral electrode of said base being in electrical contact with the internal surface of said housing, said central electrode and said peripheral electrode forming said at least two contacts.

7. The switch according to claim 6, wherein said cavity is held in contact with said conducting foil by a tubular support rendered integral with said housing by a connecting means.

8. The switch according to claim 1, wherein said pyrotechnic composition is lead azide.

9. The switch according to claim 1, wherein said conducting foil is a copper foil 0.2 to 0.5 mm thick.

* * * * *